United States Patent [19]

Owen et al.

[11] 4,158,388

[45] Jun. 19, 1979

[54] METHOD OF AND APPARATUS FOR SQUEEZE CEMENTING IN BOREHOLES

[75] Inventors: Harrold D. Owen; Wayne O. Rosenthal, both of Fort Worth, Tex.

[73] Assignee: Pengo Industries, Inc., Fort Worth, Tex.

[21] Appl. No.: 808,014

[22] Filed: Jun. 20, 1977

[51] Int. Cl.[2] ..... E21B 33/13

[52] U.S. Cl. ..... 166/286; 166/298; 166/305 R; 166/100; 175/4.51; 175/4.52

[58] Field of Search ..... 166/286, 290, 297, 63, 166/100, 242, 298, 299, 264; 175/75, 4.51, 4, 4.52, 77–81, 61

[56] References Cited

U.S. PATENT DOCUMENTS

| | | | |
|---|---|---|---|
| 2,381,929 | 8/1945 | Schlumberger | 166/100 |
| 2,500,267 | 3/1950 | Zublin | 175/75 |
| 2,526,695 | 10/1950 | Schlumberger | 166/100 |
| 2,582,719 | 1/1952 | Ramsey | 166/63 |
| 2,784,786 | 3/1957 | Walstrom | 175/4 |
| 2,915,123 | 12/1959 | Leboarg | 166/63 |
| 3,424,243 | 1/1969 | Lawrence | 166/100 |
| 3,542,141 | 11/1976 | Voetter | 166/100 |

*Primary Examiner*—Ernest R. Purser
*Attorney, Agent, or Firm*—Wofford, Fails & Zobal

[57] ABSTRACT

A well tool system including a device for downhole suspension by means of conduit for engaging and penetrating the casing wall of a wellbore and introducing a fluid into the adjacent penetration. The downhole device includes an expansion piston that extends with sufficient force to seal at least one end of the device against a wellbore casing of relatively large diameter. A projectile is subsequently fired from the device to penetrate the engaged casing and provide a selected path of egress for squeeze cementing or the like therethrough. Thereafter, the device is released from its fixed position in the wellbore by retraction of the piston and retrieved therefrom. The device is disclosed with the expansion piston and method of operation therefor shown and described in several embodiments including explosive and hydraulic actuated mechanisms.

26 Claims, 9 Drawing Figures

METHOD OF AND APPARATUS FOR SQUEEZE CEMENTING IN BOREHOLES

BACKGROUND OF THE INVENTION

This invention relates to a borehole tool, and, more particularly, to a method and apparatus for performing the downhole operation of injecting a fluid into the wall of a wellbore through a perforation made by the tool. The present invention has been developed in response to a particular problem involving a squeeze cementing operation in large diameter wellbores. Therefore, while the methods and apparatus disclosed herein would lend themselves to any operation involving injection of a fluid into the formation, the disclosure for the most part, and particularly the background of the invention, will relate to a squeeze cementing operation.

Oil and gas well cementing is a process of mixing a cement-water slurry and pumping it down through steel casing to critical points located in the annulus around the casing. Cementing a well helps provide protection against salt water flow for possible productive zones behind the casing, thus conserving the producing formation's value. Also the cement helps provide protection against corrosion of the borehole casing from subsurface mineral waters and electrolysis from the outside. In addition, cementing reduces the danger of the fresh water strata being contaminated by oil and gas or salt water flow. It also reduces the danger of a blow out caused by high pressure gas zones behind a casing and from collapsing casing caused by tremendous external pressures inherently encountered. Cementing operations for protection against the above-described downhole conditions are called primary cementing. Another type of cementing operation effected during an oil or gas well's life is secondary cementing. Secondary cementing deals with the completion and remedial repairs on a well after the producing zone is reached.

Squeeze cementing is the most common type of remedial (secondary) cementing. The process includes the utilization of hydraulic pressure to force, or squeeze, a cement slurry into contact with a formation, either in open hole or through perforations in the casing or liner. A wide selection of various types of prepared oilwell cements exists in the prior art. Adjustable water-cement ratios and various admixes provide a very flexible process for solving many problems of a corrective or remedial nature in producing oil or gas wells.

In many conditions the cement slurry may be applied to water or oil or gas bearing portions of a producing zone to eliminate excessive water or gas without sealing off the oil. This process is especially beneficial in correcting defects in producing wells. For example, where there is a problem of high gas/oil ratios, squeeze cementing can be used where an oil zone can be isolated from an adjacent gas zone, so that the gas/oil ratio can usually be improved to help increase oil production. Another example of its use is in the production of excessive water. In this case water sands can be squeezed off below the oil sand to help improve water/oil ratios. Additionally, independent water zones can usually be squeezed to eliminate water intrusion into a wellbore.

Numerous other prior art uses for squeeze cementing exist. A casing leak may be repaired by squeezing cement through the damage area. Low pressure zones that imbibe oil, gas, or drilling fluids can usually be sealed by squeeze cementing. Channeling or insufficient annular fillup behind the casing can usually be overcome by squeeze cementing. Greater protection against fluid migration into the producing zone is often possible by perforating below, squeezing perforations, repeating the process above the zone, drilling out and then perforating for production. In wells having a multiple producing zone potential, it is a common practice to isolate a zone for production and produce it to depletion. After squeezing the depleted zone, the remaining zones are, in turn, perforated, produced, depleted and plugged. In addition squeeze cementing is sometimes employed to seal off perforations or plug a depleted open hole producing zone. This helps prevent fluid migration to and from the abandoned zone.

Two prior art methods of squeeze cementing that will be described are the brandenhead method and packer method. In the bradenhead method, cement is pumped into the cased hole through tubing or drill pipe, displacing well fluids into the annulus. After the cement is placed across the zone to be squeezed, the tubing is pulled above the perforations and the annulus is closed at the surface. As pumping of cement continues, the cement moves into the zone. Circulation of the annulus is limited by the closed hydraulic system. After the cement is displaced, the slurry remaining in the casing can sometimes be reversed out. Usually however drilling is required to remove the cement. Since no packer is used, only low pressure squeezes are permitted because of casing limitations. Pinpoint accuracy of spotting the cement across the interval to be squeezed is then difficult to obtain because no packers are used.

The packer method is generally considered to be superior to the bradenhead method. The interval to be squeezed is isolated from the surface by a packer run and set on tubing. Many types of packers are conventionally available, each designed for specific well conditions, and either retrievable or permanent packers can be used. In certain instances it is necessary to isolate the section below the perforations to be squeezed. A bridge plug is placed below the perforations for this purpose. The upper perforations are then squeezed and the remaining slurry reverses out.

The packer method permits high squeeze pressures and permits more efficient placement of the slurry. However, the packer method involves the use of commercially available packers which are normally available only up to a casing size of 13 and 3/8ths inches. Problems thus arise in boreholes of larger diameters. Additionally, the packer operation is typically complex due to setting bridge plugs below perforations and the packers above. Finally, when using a squeeze packer, it is of critical importance to pressure-test the squeeze area including the packer seal and tubing and casing leaks. Even small leaks in the system can cause rapid local dehydration of the slurry and a false indication of the squeeze progression. It may thus be seen that for larger diameter casings (on the order of 36 inches) seal integrity around the squeeze is of tantamount import and prior art methods and apparatus have proven inadequate.

It would be an advantage thereof to provide a method and apparatus for squeeze cementing boreholes of relatively large diameter which could overcome the problems of the prior art. The method and apparatus of the present invention provides such a system. A downhole device is provided for utilization in any size wellbore wherein select penetration of the wellbore casing must be effected. Delivery of the slurry is herein effected through narrow conduit in closed communication with the downhole device which sealably engages the casing about the point of penetration. In this manner casing packers may be eliminated and post squeezing redrill of plugs obviated.

SUMMARY OF THE INVENTION

With these and other objects in view the present invention relates to the concept of a fluid injections and perforation system including a downhole tool, suspended in a wellbore by length of conduit and incorporating a selectively operable hold down mechanism which fixedly positions the tool in the wellbore in a selected location and moves a perforating and injection portion of the tool into solid contact with the wall of the wellbore whereupon the wellbore is penetrated to permit fluids to be pumped innto the penetration. Means are provided to selectively release the device from its fixed position for retrieval to the surface.

In another aspect, the invention includes a downhole tool constructed for angular connection to suspension conduit and the injecting of fluid carried by the conduit into the side wall of a wellbore. The tool comprises a housing having a central hub unit and a lateral body portion adapted for secured positioning within the wellbore. The lateral body includes a piston retractably mounted therein for extending outwardly thereof in abutting engagement with the side wall of the wellbore. The lateral body also includes a perforation barrel for discharging into the side wall of the wellbore and causing penetration thereof. Means are provided for selectively activating the piston to secure the tool within the wellbore and for selectively activating the perforation barrel for causing penetration. The lateral body is also formed with a passage therein in closed communication with the suspension conduit and a penetration made by the perforation barrel. In this manner fluid such as cement may be passed via the conduit into the penetration.

In yet another aspect, the invention includes a method of injecting fluid such as cement into a downhole side wall of a wellbore. A downhole tool is provided having an extendible arm section for securely wedging the tool in the wellbore. The tool is then suspended in the wellbore on a string of conduit and secured in its downhole position. A penetration member in the tool is activated to penetrate the wall of the adjacent wellbore casing. Fluid, such as cement, may then be passed through the conduit into the penetration. The tool can then be released from the wellbore by retracting the extendible arm and therein withdrawn. In this manner squeeze cementing may be effected without the use of packers and expensive redrilling operations.

DESCRIPTION OF THE PREFERRED EMBODIMENTS

Figure 1:
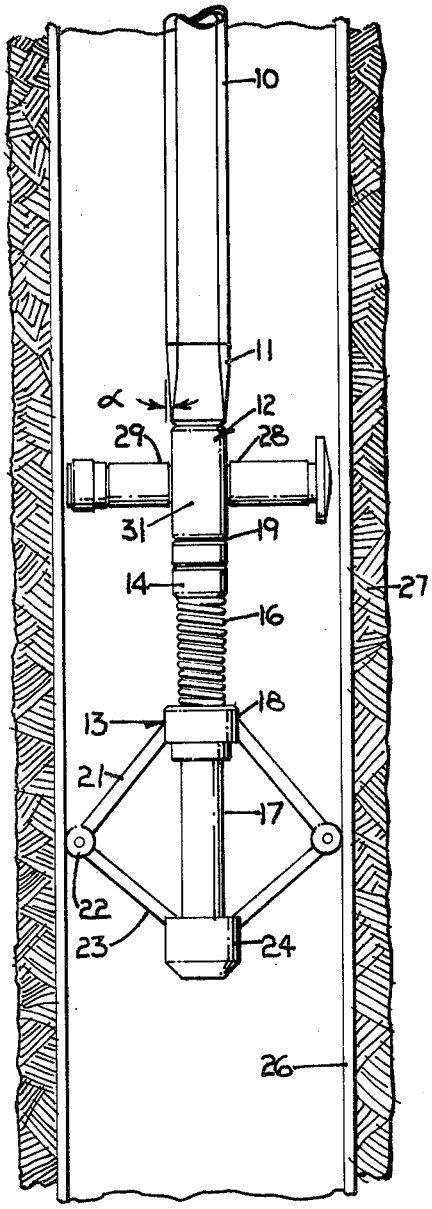
FIG. 1 is a schematic illustration of one embodiment of a well tool constructed in accordance with the principles of the present invention shown positioned in a cased borehole and illustrating the method of use thereof.

Referring now to the drawings, there is shown in FIG. 1 one embodiment of a well tool structure suspended by means of a pipe string 10, with the structure including a bent offset sub 11, a shoot and squeeze tool 12 and a depending centralizer 13 patched to a threaded bottom portion of the tool 12 and depending downwardly therefrom. The centralizer 13 includes a longitudinal body portion 17 having threaded body portion 19 at its upper end for reception within the lower, mating end of the tool 12. The centralizer also includes a threaded sleeve 14 threadably engaging the upper end of the body 19, a floating collar 18 positioned about the body 17 and arranged to slidingly move thereover in an up and down direction. A spring 16 is positioned between the sleeve 14 and the collar 18 for maintaining a spring bias against the collar, which in turn is connected to lever arms 21 for supporting rollers 22. A linkage 23 connects a bottom bullnose 24 with the rollers 22. It is readily seen that the compression spring 16 provides a force downwardly on the floating collar 18 to move the rollers 22 outwardly into a wall engaging position with the inner wall of a casing 26. As shown in FIG. 1, the casing 26 is positioned through a formation 27 with the centralizer 13 in position for centering the shoot and squeeze tool 12 therein. In this position the tool 12 is ready for operation.

Figure 2:
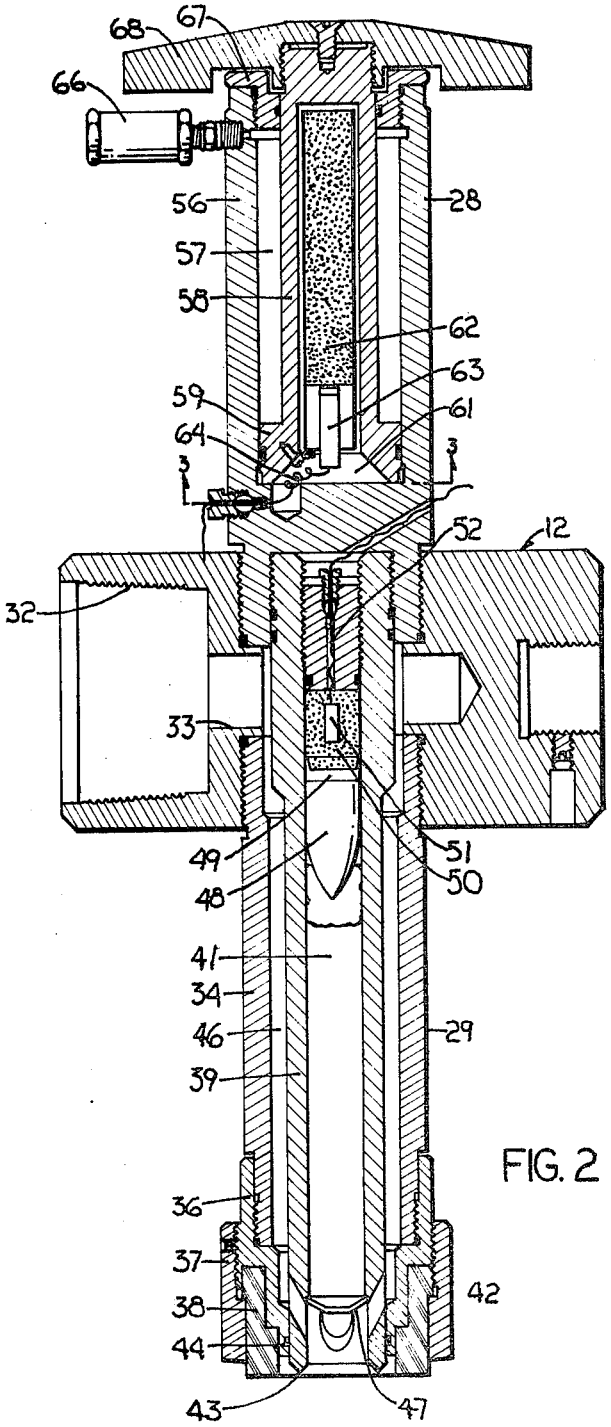
FIG. 2 is an enlarged, cross-sectional elevational view of a wall engaging portion of the well tool shown in FIG. 1.

For a more detailed description of the tool 12 reference is made to FIG. 2 of the drawings. The tool 12 includes a lateral body portion comprising a wall engaging ortion 28 and a shoot and squeeze portion 29 shown extending from opposite sides of the central hub, or tool body 31. The longitudinally extending portion of the tool body 31 has a box threaded end 32 at its upper end for receiving a mating end of a section of tubing, or as shown in FIG. 1, for receiving a mating portion of the bent sub 11. A passage 33 is therein formed centrally through the base of end 32 of body 31 for communicating the box end 32 with the interior of the lateral tool portions.

The lateral body portion of the tool 12 is adapted for wedging the tool in the wellbore and injecting a fluid such as cement into a penetration formed therein. The shoot and squeeze assembly 29 of the tool 12 may thus be seen to be comprised of an outer barrel 34 which is threadably received within the main body 31. A pair of annular collars, including inner collar 36 and outer collar 37, are threadably engaged with one another and with the barrel 34 to provide an annular space between said collars for receiving a rubber sealing member 38 therebetween. An inner or discharge barrel 39 has a central bore 41 and a plurality of ports 42 communicating its inner and outer walls near the outer end of the barrel, with the outer end of the barrel being formed in a taper to provide a sharp edge endsurface 43. A seal 44 is positioned between the outer surface of the barrel 39 and the collar 36. In this configuration a sealed fluid channel is provided in an annular space 46 formed between the outer barrel 34 and inner barrel 39, with this channel connecting with the ports 42 to the interior bore 41 of the inner barrel 39. Covering the end of the barrel 39 is a brass cap 47 being press fitted into a groove formed in the interior bore 41. At the other end of the bore 41 a case hardened steel projectile 48 is shown received within the end of the barrel. A brass gas check 49 is preferably positioned behind the projectile and separates the projectile from a black powder charge 50. A detonating fuse 51 is positioned within the powder charge and is connected to a detonating circuit operable from the surface by means of wires 52 extending through the body of the tool 12.

Still referring to FIG. 2, the wall engaging portion 28 of the tool 12 is shown extending outwardly from body 31 on the opposite side from the shoot and squeeze portion 29. The wall engaging portion 28 includes an expandable arm comprising an outer housing 56 which is threadably received within the tool body 31 to form a cylinder 57 therein. A setting piston 58 is slidably received within the housing 56 for reciprocal movement therein, and has an enlarged base portion 59 at its inner end for sealingly engaging the inner walls of the cylinder 57 circumferentially therewithin. The piston 58 has a hollow central, inner portion 61 for receiving a slow burning powder charge 62. An igniter 63 is provided for activating the powder 62 and is connected by means of wire 64 to an igniter circuit extending to the surface. A check valve 66 is shown positioned on the outside of the housing 56 and provides a means of communicating a select fluid to the cylinder 57. The outer end of the cylinder is enclosed by an endcap 67. A wall engaging pad 68 is shown attached to the outer end of the piston 58. The wall engaging pad 68 is constructed of a steel plate or ring having an outer surface configuration of an approximate radius, using angles, to facilitate centralization of the tool within the circular cross-sectional configuration of the wellbore.

Figure 3:
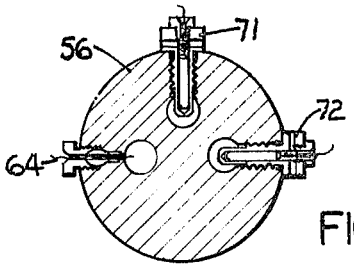
FIG. 3 is an enlarged, cross-sectional view of a portion of the tool taken along the lines 3—3 of FIG. 2.

Referring now to FIG. 3 of the drawings a pair of pressure dump screws 71 and 72 are shown threadably received within the housing 56 into passages providing a sealed fluid communication path between the interior bore 61 of the piston 58 to the exterior of the tool housing 56. These pressure dump screws preferably contain detonating fuses which are connected by means of electrical wires to the surface. Activation of the detonating fuse opens the fluid communication path between the exterior wall of the housing 56 and the interior bore 61 of the piston 58 whereby venting may be facilitated.

In the operation of the apparatus thus far described, reference may be made to FIGS. 1 and 2 as well as FIGS. 6, 7, 8 and 9. In order to introduce a fluid into the formation 27 behind the casing 26 the tool thus far described is lowered on a string of tubing 10 into the wellbore to a location where it is desired to operate the tool. Upon reaching this position, an electrical circuit is operated at the surface which connects with the wire 64 and in turn actuates the igniter 63 to ignite the slow burning powder positioned within the interior of the piston 58. Upon burning of the powder a gas is formed which expands within the chamber 61 to move the piston 58 outwardly from the tool 12 and against the sidewall of the casing 26.

Extension of the piston 58 wedges the tool 12 securely within the wellbore and therefore the piston must be retracted before the tool 12 may be removed therefrom. Prior to the running in of the tool 12 into the wellbore a compressible gas is therefore passed through the check valve 66 into the cylinder 57. As the piston 58 is moved outwardly by the expansion of the gas from the powder 62 within the interior of the piston, the existing gas within the cylinders is compressed. Upon the extended movement of the piston 58 the wall engaging pad 68 abuttingly engages the inner surface of the casing 26, thus moving or shifting the body 31 of the tool 12 in an opposite direction and moving the shoot and squeeze portion of the tool into abutting engagement with the opposite side wall of the casing. This step is clearly illustrated in FIGS. 6 and 7 wherein the centerline of the tool 12 may be seen to shift.

In the next step in the operating sequence of the tool 12, a monitored fluid pressure is placed on the interior of the tubing or pipe string 10 communicating the fluid pressure with the channel 46, ports 42 and thus with the interior bore 41 of the inner barrel as it is held against the inner wall of the casing 26. In this manner the system is checked for leaks and the seal integrity confirmed. It may be seen that the sharpened edge portion 43 on the outer end of the barrel is configured and constructed for being forced into the wall of the tubing in a mating engagement therewith to effect a seal thereupon. In addition the rubber member 38 comprising a donut shaped seal around the barrel 39 is compressed as the tool 12 is expanded into the casing wall 26 to also provide a sealing surface. If these sealing members fail to hold the aforesaid monitored pressure, the tool 12 may be removed.

Figure 7:
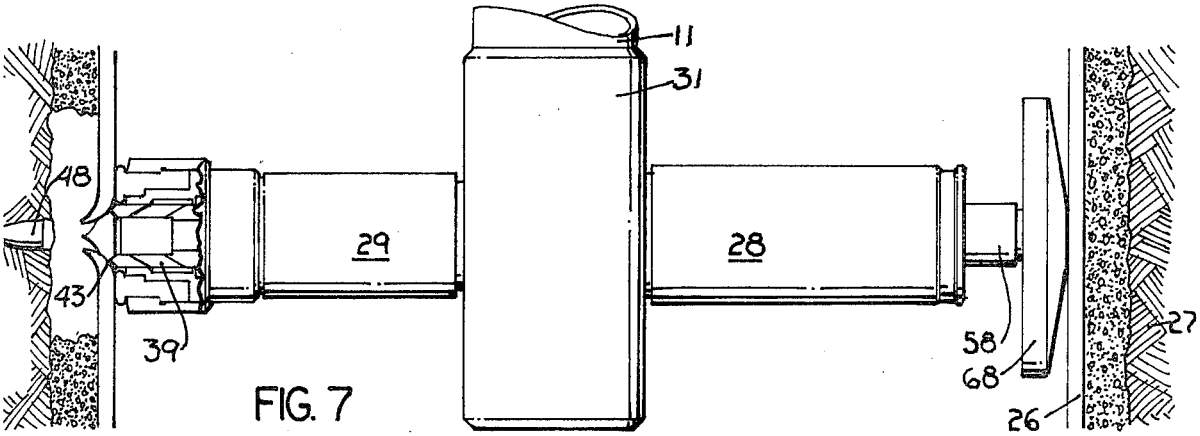

It is readily seen that when the actuating portion of the tool 12 including the wall engaging pad 68 of the piston 58 moves or shifts the tool 12 within the borehole, the tool 12 is caused to move offcenter in a pendulous fashion thus tipping the barrel 39 into a slightly nonhorizontal position. In such an offcenter configuration the sharpened pointed edge 43 would normally not strike the inner wall of the casing 26 at a ninety degree angle to effect a perfect seal. In order to compensate for this angular offset the bent sub 11 is preferably included in the tool string. The exact angle $\alpha$ of the bent sub 11 depends on the diameter of the casing 26 and the length of pipe string 10 thereabove and is readily calculable as a trigonometric function thereof. The bent sub 11 provides the offset angle to the position of the tool 12 as it hangs in the wellbore so that in the operating position of the tool 12 as shown in FIG. 7, the barrel 39 is caused to abut the inner wall of the casing 26 at a right angle therein permitting an effective seal between the sharpened edge 43 and the inner wall of the casing 26. If a proper seal has been effected, the monitored check pressure can be applied to the interior of the string 10 communicating with the interior of the barrel 41 and no pressure drop can be detected.

Once the tool 12 is secured within the wellbore and the seal has been confirmed, an electrical circuit connecting the wires 52 of the projectile 48 is activated to operate the detonating fuse 51 and in turn ignite black powder charge 50. As shown in FIG. 7, ignition of the charge and the resulting expansion moves the brass gas check seal 49 outwardly against the projectile 48 thus propelling the projectile down the barrel 41, knocking out the cap 47, penetrating the wall of the casing 26, and moving outwardly into the formation 27. This discharge effects penetration and opens the path for fluid communication from the passage 46 therewith. It should be understood that other perforation techniques are contemplated herein and the use of the projectile 48 is but one embodiment. For example, penetration may be effected by the utilization of a jet, produced by the ignition of a suitably shaped powder charge of the type conventionally used for simple casing perforation in smaller downhole applications.

Figure 8:
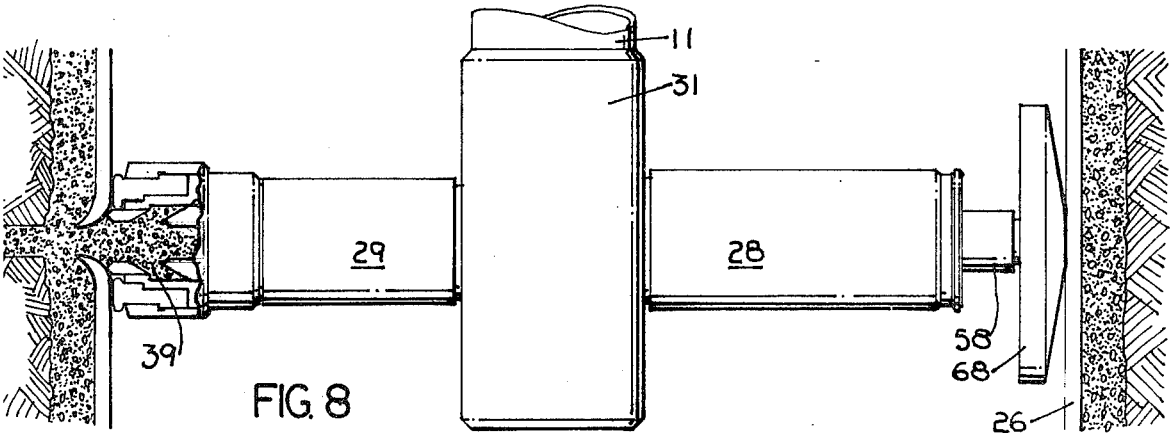
Figure 9:
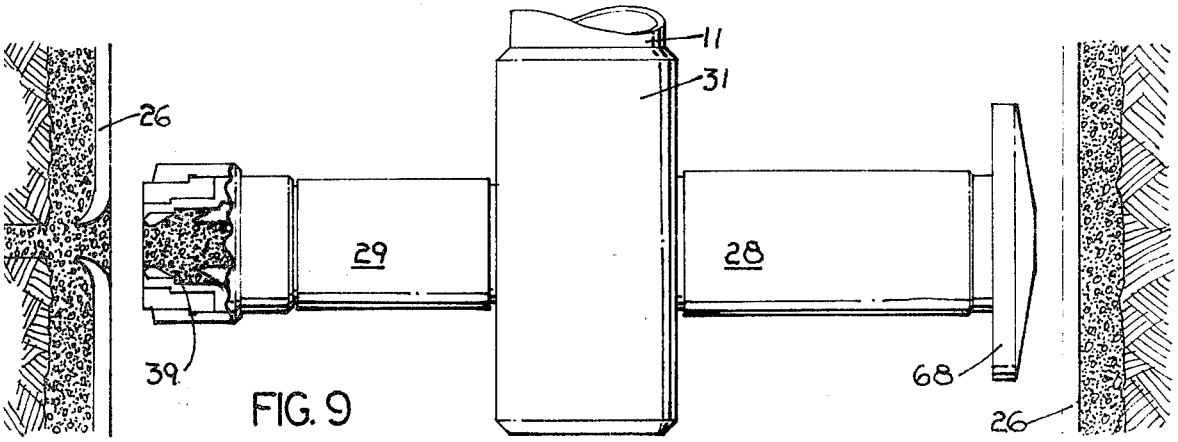

Referring now to FIG. 8 of the drawings, it may be seen that a cement slurry or other fluid is pumped from the surface through the tubing string 10 into the tool 12 through the channel 46 and ports 42 and outwardly through the end of barrel 41 into the penetration area formed by the projectile 48 in the casing 26 and thence into the desired formation behind the casing. When the cementing or other fluid injection operation is ended, and sufficient setting up time has been allowed electrical circuits are actuated first to the dump screws 71 and 72 which communicate the exterior of the housing 56 with the chamber 61 within the wall engaging portion of the tool to release pressure behind the piston 58. In this manner the previously compressed fluid within the cylinder 57 provides sufficient force upon expansion to move the enlarged portion 59 of the piston to the left and disengage the pad 68 from the casing wall 26. This retraction step permits the tool to return to the center of the wellbore as shown in FIG. 9 for retrieval to the surface, after the cement around the end of the barrel 39 has been broken. It may be seen that the area of the cement to be broken is relatively small and limited to the inside diameter of the barrel 39. For this reason, relatively small forces are required to free the tool 12 from the adjacent cemented penetration.

Figure 4:
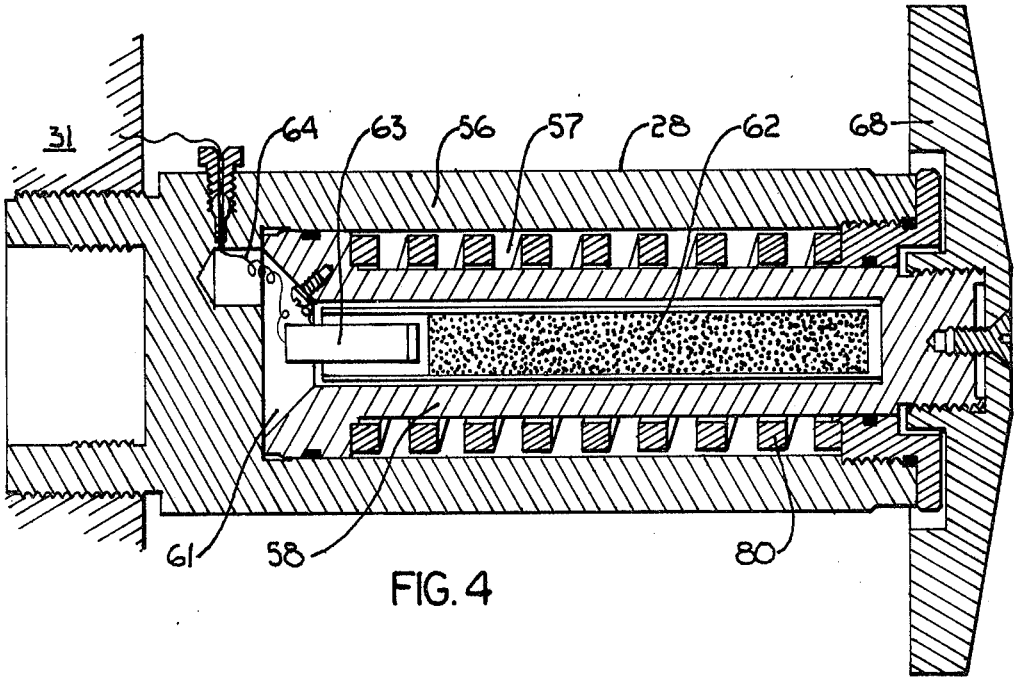
FIGS. 4 and 5 are alternative embodiments of wall engaging portions of the tool shown in FIG. 2.

Having thus far described the method and apparatus of one particular embodiment of the tool 12, various alternate embodiments, still within the spirit and scope of the present invention, will be discussed. Referring now to FIG. 4, there is shown the wall engaging portion 28 of the tool 12 including a spring 80 longitudinally disposed within the cylinder 57 of the housing 56. The spring 80 is a compression spring which functionally replaces the aforesaid gas placed within the cylinder 57 prior to use of the tool 12. The use of nitrogen as the subject gas has been found satisfactory in the above described application. However, the effectiveness of the gas depends upon its compression by the piston 58 and the integrity of the seals therearound. In order to eliminate this one area of seal criticality, the spring 80 may be utilized, since it requires no seal. The spring 80 is simply compressed during the extension of the piston 58 and, once the expansion pressure is vented through screws 71 and 72, the spring 80 expands and retracts the piston. Since no cylinder gas is required, the pressure of check valve 66 may be seen to have been eliminated in this embodiment.

Figure 5:
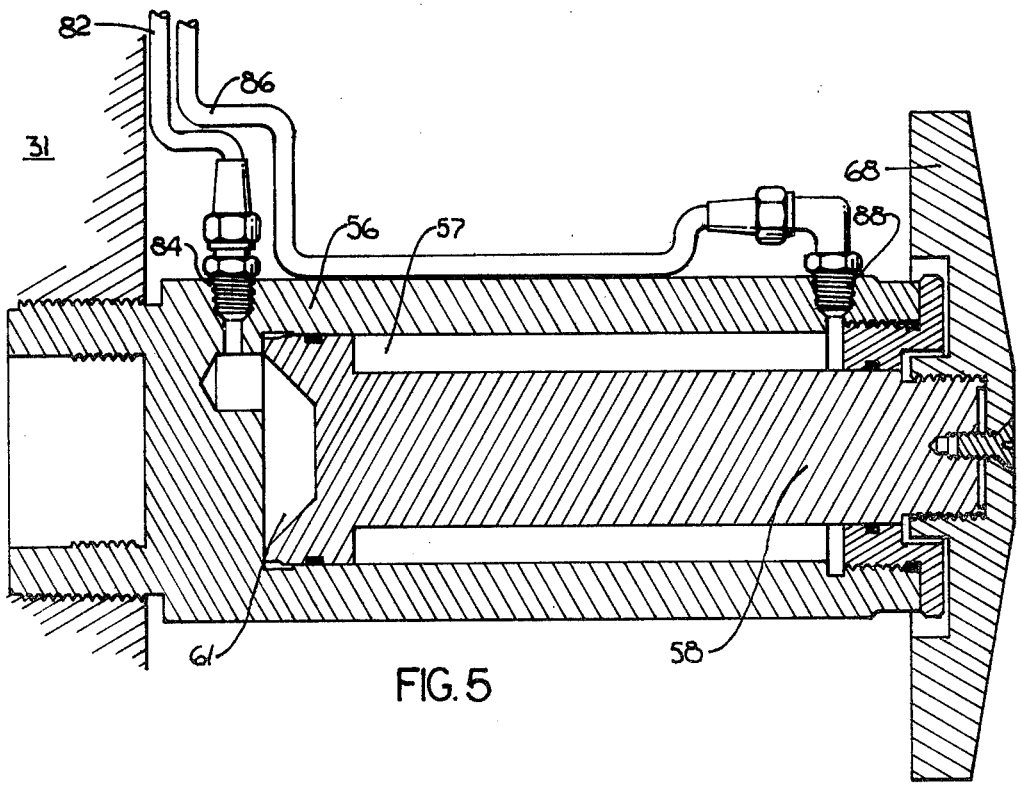
Figure 6:
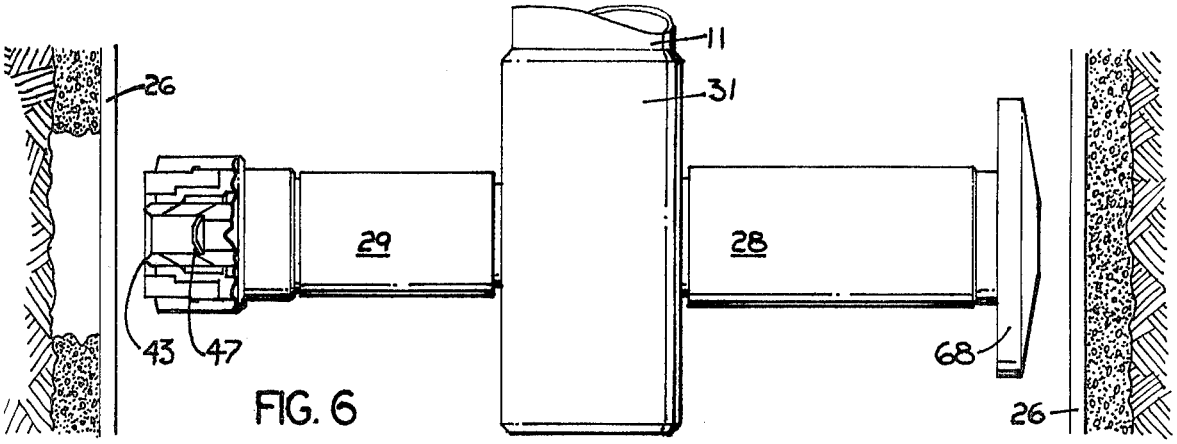
FIGS. 6, 7, 8 and 9 are schematic illustrations of the portions of the particular embodiment of the tool shown in FIG. 2 performing a downhole operation.

Referring now to FIG. 5, there is shown the wall engaging portion 28 of the tool 12 including hydraulic lines in communication with the cylinder 57 of housing 56. The utilization of an hydraulic system functionally replaces the powder charge 62, igniter 63, ignition wire 64, and check valve 66. A first hydraulic line 82 formed of flexible steel pipe, or the like, is sealably connected to the housing 56 through a fitting 84 threadably secured therein. Hydraulic fluid is thus communicated to the hollow, central inner portion 61 of the piston 58 for forcing the piston outwardly. A second hydraulic line 86 is sealably connected to the housing 56 through a fitting 88 threadably secured therein. Hydraulic fluid is similarly communicated to the cylinder 57 around the piston 58 for forcing the piston inwardly. In operation, fluid is pumped from the surface through line 82 to wedge the tool 12 in the wellbore at a select time. Fluid is thus received into line 86 from the cylinder 57 as the piston 58 is extended. Retrieval of the tool 12 is effected by the reverse process. The advantage of such a system is positive control of the position integrity of the tool 12. Since hydraulic pressures are monitored at the surface the expansion force of the piston 58 can be checked. The use of powder charge 62, although totally effective does not provide the surface to downhole control and monitoring parameters. Moreover, for prolonged squeeze cementing operations the hot, expanded gas produced by the burning of powder 62 can cool and reduce the expansion pressure to some degree. With the hydraulic system herein set forth and described such considerations are obviated.

The utilization of a pressure fluid such as the hydraulic system described also provides the following alternative embodiments which are not particularly set forth and shown in the figures. An hydraulic line 82 may be provided to expand the piston 58 through the housing 56 in order to seat the tool 12. In place of a return line 86, either the gas or the spring embodiments shown in FIGS. 2 and 4, respectively, may be utilized. In this manner, a positive expansion control may be effected for wedging and seating the tool 12 in the wellbore, while the simpler gas or the spring elements are utilized to retract the piston 58. It may also be seen that a positive expansion may be effected utilizing the pipe string 10 to carry pressure fluid, such as gas, to the cavity 61 behind the piston 58. Flow passages, not shown, may be constructed in the body 31 to responsively segregate the function of the pipe string 10 from one of pressurizing the piston cavity 61, to one of communicating with the annulus 46. For example, the body 31 may be provided with a rotatable valve element, responsive to the pipe string rotational position and/or a ball dropped down the pipe string 10 from the surface. The valve element may be set in communication with the cavity 61 upon the lowering of the tool into the borehole, wherein the tool may be wedged and securely held therein by the piston 58. With the tool 12 securely held, the pipe string may be rotated relative thereto, sealing off the cavity 61 and opening communication with the annulus 46, through which fluid injection is to be effected. After the injection operation is completed, the pipe string 10 may be rotated back to vent the seating pressure from the cavity 61. The compressed spring or gas retraction construction above described may be utilized to then return the piston 58 to its retrieval position. Similarly, the pressure dump screws 71 and 72 may be utilized to vent the pressure in cavity 61 rather than rotating the pipe string 10 in this particular alternative embodiment.

The methods and apparatus herein described also provide numerous functional advantages. With the tool 12, there is no need for a conventional large diameter packer to squeeze under, which would require extremely large hold-down anchors and elaborate back flow to wash out the excess cement after squeezing. For example, some cement will be left in the tool 12 and lower part of the pipe string 10 after squeezing. It may be preferable to wash out this excess downhole simply for tool maintenance. Such an operation is easily facilitated by pumping fluid down the casing 26 after the tool 12 is unseated. If the unseating occurs before the cement is completely set, the fluid will flow into the end of the barrel 39, through the ports 47 and the annulus 46 and up the pipe string 10 to clear the passage of cement.

It is believed that the operation and construction of the above described invention will be apparent from the foregoing description. While the method of and apparatus for squeeze cementing in boreholes shown and described has been characterized as being preferred, it will be obvious that various other changes and modifications may be made therein without departing from the spirit and scope of the invention as defined in the following claims.

What is claimed is:

1. A wellbore downhole tool constructed for connection to suspension conduit and the injecting of fluid carried by said conduit into the side wall of a metal casing lining a wellbore, said tool comprising:

a housing having a central hub unit intermediate of a laterally extending body adapted for fluid communication with said suspension conduit;

said lateral body comprising a radially outwardly extending wall engaging portion including a piston retractably mounted therein for extending outwardly into abutting engagement with the side wall of the wellbore;

said lateral body further comprising an injection portion extending radially outwardly in diametric opposition to and in axial alignment with said wall engaging portion, said injection portion also including a perforation barrel for explosively discharging a projective into the side wall of the wellbore and causing penetration thereof, the outer end of said injection portion having annular sealing means for engagement with the side wall of the wellbore casing;

means for selectively activating said piston to securely position said tool transversely across the wellbore casing and bring the annular sealing means of said injection portion into secure sealed engagement with the wall of the wellbore casing;

means for selectively activating said perforation barrel with explosive means to discharge and penetrate the wellbore casing within the region surrounded by said annular sealing means with said projectile;

the injection portion of said lateral body being formed with a passage therein in closed communication with the intermediate central hub unit, the suspension conduit and a penetration made by said perforation barrel for passing the fluid through the annular sealing means into the penetration without allowing the fluid into the interior of the casing.

2. The downhole tool set forth in claim 1 wherein fluid injected into the side wall of the wellbore is comprised of cement and the fluid injection is squeeze cementing.

3. The downhole tool set forth in claim 1 wherein said perforation barrel includes a projectile and powder charge disposed therebehind for propelling said projectile through and outwardly of said barrel.

4. The downhole tool set forth in claim 1 wherein said means for activating said piston includes a powder charge disposed for expansion therebehind upon ignition thereof.

5. The downhole tool set forth in claim 4 wherein said tool also includes means for retracting said piston following fluid injection.

6. The downhole tool set forth in claim 5 wherein said means for retracting said piston includes a compressible gas disposed in a sealed configuration therearound and compressible upon extension thereof.

7. The downhole tool set forth in claim 5 wherein said means for activating and retracting said piston includes a pressure fluid system interconnecting the surface of the wellbore with opposite sides of said piston for controllably positioning said piston relative to the side wall of the wellbore.

8. The downhole tool set forth in claim 1 wherein said tool is connected to the suspension conduit through a bent sub having a bend configuration of a degree compensatory to an angular offset imparted to said tool during extension of said piston for secured positioning.

9. A wellbore downhole tool as set forth in claim 1 wherein said annular sealing means includes sharp angular edges formed around the periphery of the end of the perforation barrel, which sharp edges deformingly engage the inner wall of the casing to form a secure metal-to-metal seal therebetween when the tool is securely positioned within the casing.

10. A wellbore downhole tool as set forth in claim 9 wherein said annular sealing means also includes a ring of resilient material surrounding the end of the perforation barrel to form an additional seal against leakage of the fluid being injected into the casing.

11. A wellbore fluid injection system including; conduit means for providing a fluid flow path from the surface to a position in a metal wellbore casing where a fluid is to be passed into the wall of the casing; and a lateral tool portion suspended in the wellbore by means of said conduit means, said lateral tool portion including a radially outwardly extendible wall engaging portion and a diametrically opposed perforating-fluid injection portion including means for sealing an area upon the wellbore casing wall from fluid communication with the interior of the wellbore casing and means for perforating the side of the wellbore casing within the area sealed off from the wellbore casing with an explosively propelled projectile and passage means for permitting fluid communication between the perforation in the side of the wellbore casing and said conduit means.

12. The apparatus set forth in claim 11 wherein said lateral tool portion includes a centralizer means depending therefrom for the centering the tool in the wellbore during insertion and withdrawal.

13. The apparatus set forth in claim 11 wherein said wall engaging portion includes a movable member and selectively operable means for extending said movable member into contact with a side of the wellbore to secure the fluid injection system in a fixed position therein and bring said sealing means into secure engagement with the wall of the wellbore.

14. The apparatus set forth in claim 13 wherein said wall engaging portion further includes selectively operable means for retracting said movable member to disengage said wall engaging portion from the wellbore casing wall.

15. The apparatus set forth in claim 14 wherein said retracting means includes a chamber containing a compressible fluid.

16. The apparatus set forth in claim 14 wherein said retracting means includes a spring.

17. The apparatus set forth in claim 11 wherein said perforating-fluid injecting portion includes a projectile and powder charge disposed therebehind for propelling said projectile through and outwardly of the wall of the wellbore.

18. The apparatus set forth in claim 11 and including a bent sub disposed between said conduit means and said lateral tool portion suspended thereby.

19. A well tool for use in a wellbore having a metal casing including; means for connecting said well tool into fluid communication with the surface, wall engaging means selectively extendable into contact with the wall of the wellbore casing, selectively operable means activated by the extension of said wall engaging means for retracting said wall engaging means from an extended position, means, actuated in response to extension of said wall engaging means, for sealing an area on the wall of the metal casing from fluid communication with the interior of the casing, selectively operable means including an explosively propelled projectile for penetrating the wall of the wellbore casing within the area sealed from fluid communication with the interior of the casing; and passage means extending from said connecting means for passing a fluid into a penetration made by said projectile without permitting the fluid to pass into the interior of the casing.

20. A well tool as set forth in claim 19 wherein said sealing means includes sharp angular edges formed around the periphery of an end of said penetration means, which sharp edges deformingly engage the inner wall of the casing to form a secure metal-to-metal seal therebetween when the tool is securely positioned within the casing.

21. A well tool as set forth in claim 20 wherein said annular sealing means also includes a ring of resilient material surrounding the end of said penetration means to form an additional seal against leakage of the fluid being injected into the casing.

22. A method of squeeze cementing a region outside of a casing in a wellbore including steps of:

suspending a perforating-cementing tool in the wellbore on a packerless conduit, securing the tool in a fixed position in the wellbore casing, sealing an area on the inner wall of the casing from fluid communication with the interior of the casing, activating an explosively propelled projectile in the tool to penetrate the wall of the casing within the sealed area on the inner wall of the casing; and passing cement through the conduit into the penetration in the casing, releasing the tool from its fixed position in the wellbore after the cement has hardened, and withdrawing the conduit and tool from the wellbore.

23. A method of injecting fluid into a downhole side wall of a wellbore casing including the steps of:

providing a downhole tool having an extendible arm section for securely wedging the tool in the wellbore and means for sealng an area on the sidewall of the casing from fluid communication with the interior of the casing when the tool is securely wedged;

coupling the tool to a length of conduit for positioning in the wellbore and providing flow through communication between the conduit and a passage formed in the tool;

suspending the tool in the wellbore at a select downhole position;

activating the extendible arm of the tool to wedge the tool in a secured position;

activating an explosively activated projectile in the tool to penetrate the wall of the wellbore casing within the sealed off area;

providing fluid flow through the conduit, the passage formed in the tool and the penetration in the wall of the casing;

retracting the extendible arm of the tool and releasing it from its fixed position in the wellbore; and withdrawing the conduit and tool from the wellbore.

24. The method set forth in claim 23 wherein the step of activating the extendible arm includes the step of imparting a fluid pressure behind the arm within the tool.

25. The method as set forth in claim 24 wherein the step of retracting the extendible arm includes the steps of biasing the arm in the retracted position and venting the fluid pressure from behind the arm.

26. The method set forth in claim 23 wherein the penetrating member is a projectile which is activated by igniting a powder charge disposed therebehind.

* * * * *